US008291874B2

(12) United States Patent
Yang et al.

(10) Patent No.: US 8,291,874 B2
(45) Date of Patent: Oct. 23, 2012

(54) APPARATUS FOR ADJUSTING DEVIATION OF ENGINE AND CONTINUOUSLY VARIABLE VALVE LIFT DEVICE INCLUDING THE SAME

(75) Inventors: Jei Choon Yang, Yongin-si (KR); Young Hong Kwak, Suwon-si (KR); Ki Uk Shin, Hwaseong-si (KR); Jin Kook Kong, Suwon-si (KR); Soo Hyung Woo, Yongin-si (KR); Jin Soon Kim, Hwaseong-si (KR); Ki Young Kwon, Hwaseong-si (KR)

(73) Assignee: Hyundai Motor Company, Seoul (KR)

( * ) Notice: Subject to any disclaimer, the term of this patent is extended or adjusted under 35 U.S.C. 154(b) by 390 days.

(21) Appl. No.: 12/573,714

(22) Filed: Oct. 5, 2009

(65) Prior Publication Data

US 2010/0139590 A1 Jun. 10, 2010

(30) Foreign Application Priority Data

Dec. 5, 2008 (KR) ..... 10-2008-0123625
Dec. 5, 2008 (KR) ..... 10-2008-0123629

(51) Int. Cl.
*F01L 1/34* (2006.01)

(52) U.S. Cl. ..... 123/90.16; 123/90.39; 123/90.44; 74/569

(58) Field of Classification Search ..... 123/90.39, 123/90.44, 90.16; 74/567, 569
See application file for complete search history.

(56) References Cited

U.S. PATENT DOCUMENTS 6,499,454 B2 * 12/2002 Miyazato et al. ..... 123/90.31

FOREIGN PATENT DOCUMENTS

| | | | |
|---|---|---|---|
| JP | 8-270421 | A | 10/1996 |
| JP | 2001-132421 | A | 5/2001 |
| JP | 2002-38913 | A | 2/2002 |
| JP | 2004-270608 | A | 9/2004 |
| JP | 2005-098279 | A | 4/2005 |
| JP | 2005-264841 | A | 9/2005 |
| JP | 2006-105082 | A | 4/2006 |
| JP | 2007-198387 | A | 8/2007 |
| JP | 2008-208779 | A | 9/2008 |
| JP | 2008-286145 | A | 11/2008 |
| KR | 10-2008-0043521 | A | 5/2008 |
| KR | 10-2010-0027773 | A | 3/2010 |

* cited by examiner

*Primary Examiner* — Ching Chang
(74) *Attorney, Agent, or Firm* — Morgan, Lewis & Bockius LLP

(57) ABSTRACT

An apparatus for adjusting deviation of an engine and a continuously variable valve lift device including the same are provided. The apparatus for adjusting deviation of an engine includes an adjustment member connecting a rocker arm to plural output cams, respectively, to adjust lengths between the rocker arm and the output cams, respectively, so that the lengths become equal to or different from each other. The continuously variable valve lift device includes an eccentric cam shaft with eccentric cams installed on its outer periphery, a rocker arm rotatably installed on the eccentric cams to interlock with plural output cams, and apparatus for adjusting deviation provided on the rocker arm to adjust lengths between the rocker arm and the output cams so that the lengths become equal to or different from each other.

12 Claims, 7 Drawing Sheets

APPARATUS FOR ADJUSTING DEVIATION OF ENGINE AND CONTINUOUSLY VARIABLE VALVE LIFT DEVICE INCLUDING THE SAME

CROSS-REFERENCE TO RELATED APPLICATION

The present application claims priority to Korean Patent Application Nos. 10-2008-0123629 and 10-2008-0123625 filed on Dec. 5, 2008, the entire contents of which are incorporated herein for all purposes by this reference.

BACKGROUND OF THE INVENTION

1. Field of the Invention

The present invention relates to an apparatus for adjusting deviation of an engine and a continuously variable valve lift device including the same, and more particularly, to an apparatus for adjusting deviation of an engine and a continuously variable valve lift device including the same, which can adjust deviation of valves through adjustment of lengths between a rocker arm and plural output cams so that the lengths become equal to or different from each other.

2. Description of Prior Art

Recently, in order to improve thermal efficiency and output, an attempt to vary valve lift, opening/closing period and time of intake and exhaust valves has been actively made, and one of devices developed as a part of such efforts is a continuously variable valve lift device.

That is, the continuously variable valve lift device can optimize the opening/closing time of the intake/exhaust valves and movement of the valves such as valve lift in accordance with operational conditions of the engine. Accordingly, it can maximize a flow rate of the intake air at high speed/high load requiring high output, and minimize an effect of EGR (Exhaust Gas Recirculation) or a loss of throttle at low speed/low load where it is important to improve fuel economy or to reduce exhaust gas.

The continuously variable valve lift devices have been developed to have diverse structures, and one of them is a link-structured variable valve lift device in which a rotating force of a drive cam is delivered through link mechanism, and thus valves are lifted.

According to this link-structured variable valve lift device as described above, however, assembly tolerance occurs when various kinds of links are assembled, and due to the accumulated amount of such tolerance, there is a difference between an initially designed valve profile and an actually measured valve profile. This difference causes deviation of an engine to occur, and it is required to correct such deviation.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide an apparatus for adjusting deviation of an engine and a continuously variable valve lift device including the same, which can adjust deviation of valves through adjustment of lengths between a rocker arm and plural output cams so that the lengths become equal to or different from each other.

In an aspect of the present invention, the apparatus for adjusting deviation of a valve for a continuously variable valve lift device, may include an adjustment member eccentrically connecting a rocker arm to a plurality of output cams to adjust lengths between the rocker arm and the output cams, respectively, so that the lengths become equal to or different from each other.

The apparatus may further include a reverse rotation prevention member installed in a mount portion of the rocker arm and coupled to the adjustment member to prevent reverse rotation of the adjustment member.

The adjustment member may include a pin cam having a worm wheel formed on an outer periphery thereof, the reverse rotation prevention member having a worm gear formed thereon to be engaged with the worm wheel, and a plurality of pin shafts connected to the pin cam, wherein center axes of the pin shafts are eccentrically provided from a rotation axis of the pin cam and connected to the plurality of output cams by link mechanisms respectively.

A rotation axis of the reverse rotation prevention member and the rotation axis of the pin cam may be perpendicular.

The center axes of the plurality of pin shafts may be positioned in the same quarter, based on the rotation axis of the pin cam.

An included angle between the center axes of the plurality of pin shafts with respect to the rotation axis of the pin cam may be approximately zero.

The center axes of the plurality of pin shafts may be positioned in the first quarter and the third quarter, respectively, based on the rotation axis of the pin cam.

An included angle between the center axes of the plurality of pin shafts with respect to a rotation axis of the pin cam may be approximately 180 degrees.

The center axes of the plurality of pin shafts may be positioned in the first quarter and the second quarter, respectively, based on the rotation axis of the pin cam.

An included angle between the center axes of the plurality of pin shafts with respect to the rotation axis of the pin cam may be approximately 90 degrees or less.

The adjustment member may connect plural link mechanisms, which are provided between the plurality of output cams and the rocker arm, respectively, to the rocker arm.

The plural link mechanisms may be coupled to the plurality of pin shafts, respectively, and a part where the worm wheel is engaged with the worm gear is positioned in the center of the pin cam.

According to another aspect of the present invention, there is provided a continuously variable valve lift device, which includes an eccentric cam shaft with eccentric cams installed on its outer periphery; a rocker arm rotatably installed on the eccentric cams to interlock with plural output cams; and apparatus for adjusting deviation, provided on the rocker arm, to adjust lengths between the rocker arm and the output cams so that the lengths become equal to or different from each other.

With the above construction, the lengths between the rocker arm and the plural output cams can be adjusted so that the lengths become equal to or different from each other, and thus the deviation of the valves can be adjusted.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

Figure 1:
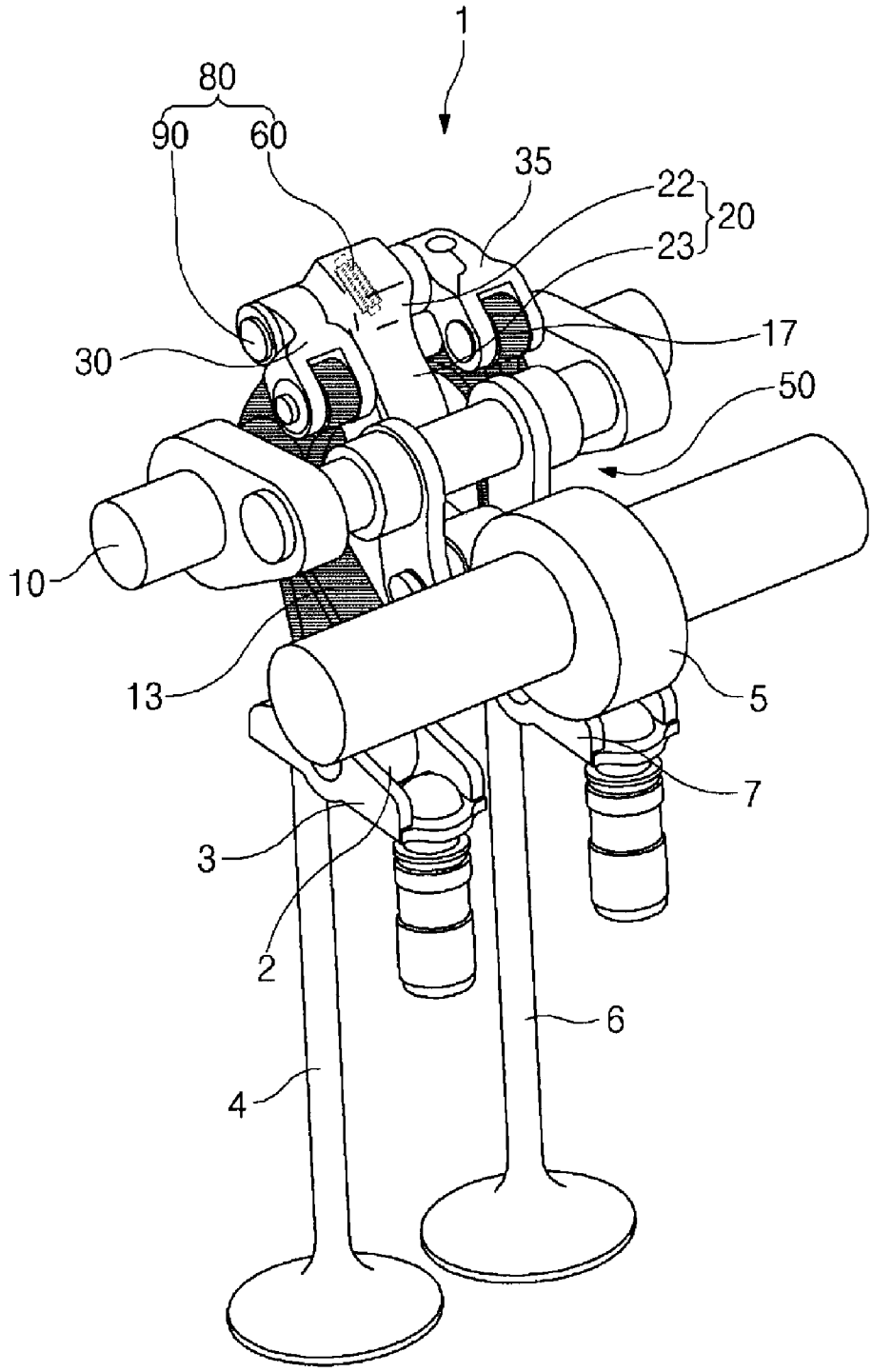
FIG. 1 is a perspective view illustrating a continuously variable valve lift device having apparatus for adjusting deviation of an engine according to various embodiments of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

FIG. 1 is a perspective view illustrating a continuously variable valve lift device having apparatus for adjusting deviation of an engine according to a first exemplary embodiment of the present invention.

The continuously variable valve lift (CVVL) device 1 according to an exemplary embodiment of the present invention includes an eccentric cam shaft 10 with eccentric cams installed on its outer periphery; a rocker arm 20 rotatably installed on the eccentric cams to interlock with plural output cams 13 and 17; link mechanisms 30 and 35 receiving a rotating force of a drive cam and adjusting lift amounts of valves 4 and 6 in accordance with rotation amounts of the eccentric cams; and apparatus for adjusting deviation 80, connecting the rocker arm 20 and the link mechanisms 30 and 35, respectively, and adjusting the deviation of the respective link mechanisms 30 and 35.

The eccentric cam shaft 10 is connected to a CVVL motor that can perform continuously variable control of a rotation angle, and thus the rotation angle thereof is variably adjusted. In the center part of the eccentric cam shaft 10, the eccentric cams are mounted in a body.

The eccentric cam is installed in an eccentric cam installation part 23 of the rocker arm 20 to be described later, and a marginal gap for rotation of the eccentric cam exists in the eccentric cam installation part 23.

A drive cam 5 is connected to a crank shaft by a timing belt or a timing chain, and is rotated by the rotation force of the crank shaft. In this case, as the eccentric cams are variably rotated in accordance with a drive region of an engine by the CVVL motor, the drive cam 5, which interlocks with the crank shaft, operates the output cams 13 and 17 connected to the link mechanisms 30 and 35 to lift the valves 4 and 6 to a high or low position.

Figure 2:
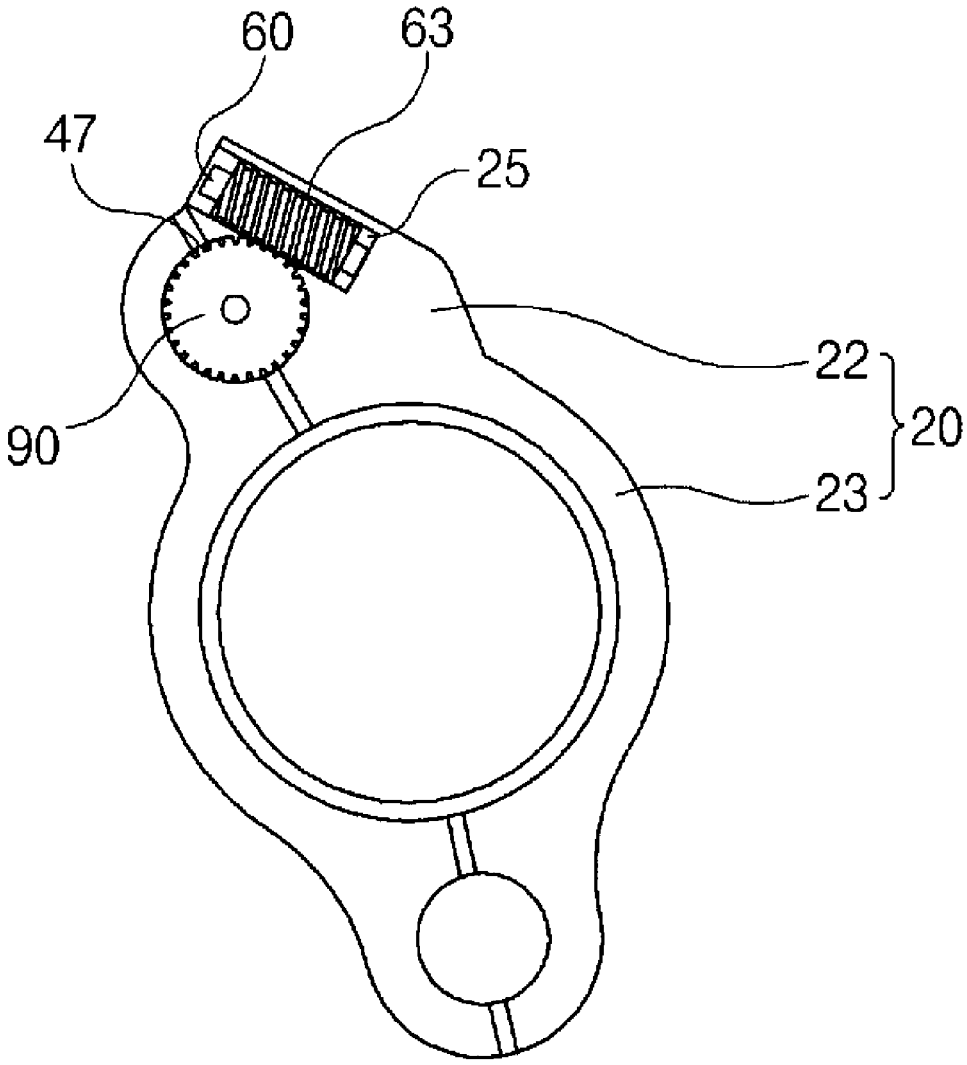
FIG. 2 is a sectional view illustrating a rocker arm and apparatus for adjusting deviation as illustrated in FIG. 1.

The rocker arm 20, as illustrated in FIG. 2, is composed of an eccentric cam installation part 23 formed in the center thereof to install thereon the eccentric cams, and a rotation support part 22 which is extended from the eccentric cam installation part 23 and in which the apparatus for adjusting deviation 80 is rotatably inserted.

The link mechanisms include a left link mechanism 30 provided on the left of the rocker arm 20, and a right link mechanism 35 provided on the right of the rocker arm 20. The left link mechanism 30 and the right link mechanism 35 are connected together by an adjustment member 90 to be described later.

On one side of the link mechanisms 30 and 35, a separate link mechanism 50 is provided in contact with the drive cam 5 and the valves 4 and 6 to deliver the rotating force of the drive cam 5 to the link mechanism 30. Here, end parts of the valves 4 and 6 are coupled to swing arms 3 and 7 to which swing arm rollers 2 are connected. In accordance with the rotation of the drive cam 5, the swing arm rollers 2 are pressed by the separate link mechanism 50, and thus the swing arms 3 and 7 are also pressed to lift the valves 4 and 6. Since the operation principle thereof is disclosed in Korean Patent Application No. 2008-0047713, the detailed description thereof will be omitted.

Figure 3A:
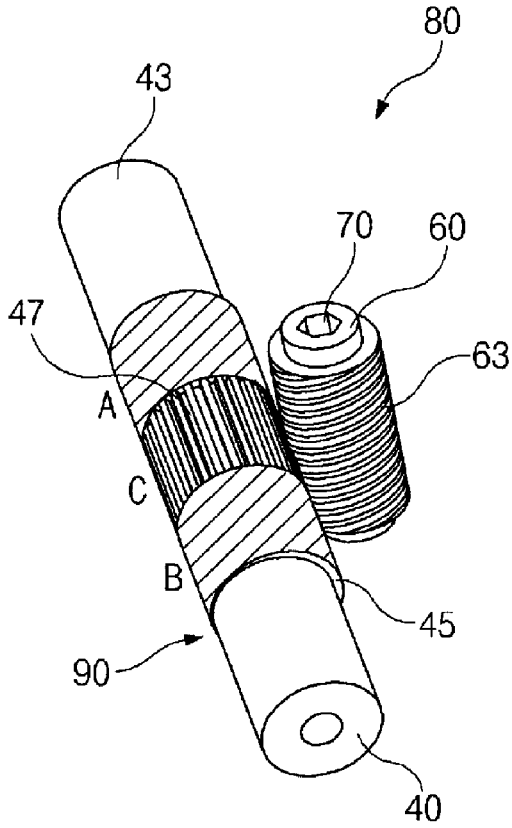
FIG. 3A is a perspective view illustrating the apparatus for adjusting deviation as illustrated in FIG. 2.

The apparatus for adjusting deviation 80 for the continuously variable valve lift device, as illustrated in FIG. 3A, includes an adjustment member 90 which connects the rocker arm 20 to the link mechanisms 30 and 35, and is rotated to adjust the deviation of the output cams 13 and 17, and a reverse rotation prevention member 60 mounted on a mount portion 25 (See FIG. 2) formed on the rocker arm 20 to prevent the reverse rotation of the adjustment member 90.

Figure 3B:
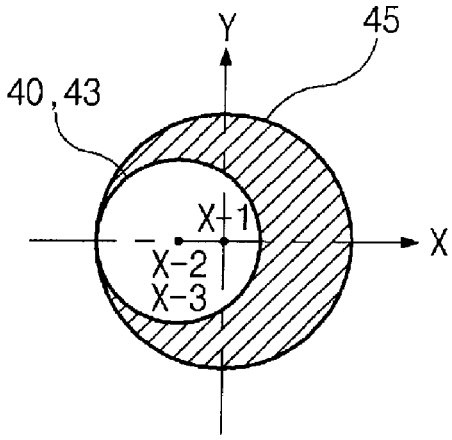
FIG. 3B is a front view of an adjustment member as illustrated in FIG. 3A.

The adjustment member 90 connects the rocker arm 20 to the link mechanisms 30 and 35, and adjusts the lengths of the link mechanisms 30 and 35 at a time. The adjustment member 90 is composed of a pin cam 45 having a worm wheel 47 formed on its outer periphery, and plural pin shafts 40 and 43 eccentrically provided in the same direction from the pin cam 45 and coupled to the link mechanisms 30 and 35, respectively. In this case, the shaft centers X-2 and X-3 of the pin shafts 40 and 43 are eccentric on the basis of the shaft center X-1 of the pin cam 45 as illustrated in FIG. 3B.

In the case where deviation occurs in the link mechanisms 30 and 35, profiles of the valves 4 and 6 are changed, and thus it is required to accurately adjust the deviation of the link mechanisms 30 and 35. For this, replacement of the link mechanisms 30 and 35 is troublesome since not only the separate link mechanism 50 but also other components should be separated and then re-assembled. According to the present invention, however, by rotating the adjustment member 90 using the reverse rotation prevention member 60, the lengths of the link mechanisms 30 and 35 are changed, and thus the deviation can be adjusted.

The pin cam 45 may be divided into parts A, B, and C. The delivering force of the link mechanisms 30 and 35 acting on the respective pin shafts 40 and 43 is mostly concentrated on parts A and B of the pin cam 45, but is hardly concentrated on part C of the pin cam 45. Accordingly, even by applying a small tightening force to part C, the reverse rotation of the adjustment member 90 can be prevented.

That is, since the force delivered to the link mechanisms 30 and 35 hardly acts on part C of the pin cam 45, a large tightening force of the reverse rotation prevention member 60 is not required.

Also, since the delivering force of the link mechanisms 30 and 35 does not strongly act on the part where the worm wheel 47 of the adjustment member 90 and the worm gear 63 of the reverse rotation prevention member 60 are engaged with each other, the fixing force of the worm wheel 47 and the worm gear 63 becomes strong, and thus the deviation of the link mechanisms 30 and 35 can be prevented from occurring at maximum.

The reverse rotation prevention member 60 is arranged to cross at right angles with the shaft direction of the adjustment member 90, and on the outer periphery of the reverse rotation prevention member 60, the worm gear 63 for being engaged with the worm wheel 47 is formed to prevent the rotation of the adjustment member 90.

Since the worm gear 63 is engaged with the worm wheel 47 to prevent the reverse rotation of the worm wheel 47, a separate work for fixing the adjustment member 90 is not required, and thus the workability is improved. In this case, it is also possible to fasten a fixing nut to the outer periphery of the reverse rotation prevention member 60 in order to heighten the fixing force of the work wheel 47 and the worm gear 63.

In the center of the reverse rotation prevention member 60, an adjustment hole 70 is formed. By inserting a tool into the adjustment hole 70 and rotating the reverse rotation prevention member 60, the adjustment member 90 is rotated to adjust the deviation of the link mechanisms 30 and 35.

That is, if an operator rotates the reverse rotation prevention member 60 tooth-engaged with the adjustment member 90, not the adjustment member 90, the adjustment member 90 is rotated. After the deviation of the link mechanisms 30 and 35 is adjusted, the position of the adjustment member 90 should be fixed to prevent the deviation of the link mechanisms 30 and 35 from re-occurring. Since the worm wheel 47 of the adjustment member 90 is not rotated in an opposite direction by the worm gear 63 of the reverse rotation prevention member 60, a separate component for fixing the adjustment member 90 is not required.

As described above, according to an exemplary embodiment of the present invention, after the lengths of the output cams 13 and 17 connected to the rocker arm 20 is adjusted by the rotation of the adjustment member 90, the position of the adjustment member 90 is fixed by the reverse rotation prevention member 60, and thus the deviation of the output cams 13 and 17 connected to the rocker arm 20 is prevented from occurring.

Figure 4A:
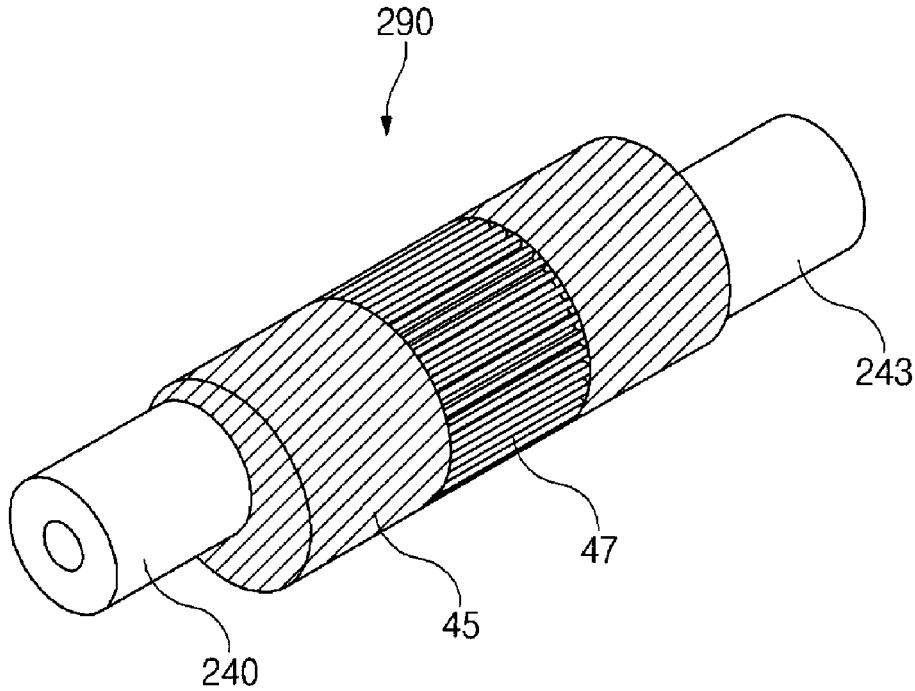
FIG. 4A is a perspective view illustrating an adjustment member of apparatus for adjusting deviation, provided in a continuously variable valve lift device, according to various embodiments of the present invention.
Figure 4B:
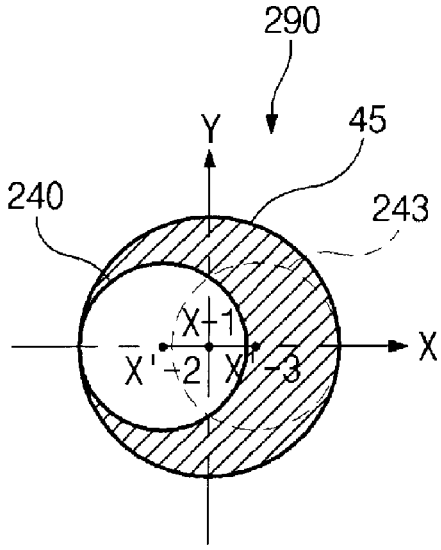
FIG. 4B is a front view of the adjustment member as illustrated in FIG. 4A.

On the other hand, the adjustment member 290, as illustrated in FIG. 4A and FIG. 4B, may be composed of a pin cam 45 coupled to the rocker arm 20, and plural pin shafts 240 and 243 which are eccentric in different directions from the shaft center X-1 of the pin cam 45 and are coupled to the link mechanisms 30 and 35, respectively.

The pin shafts include the left pin shaft 240 eccentrically provided in one direction from the shaft center X-1 of the pin cam 45 and coupled to the left link mechanism 30, and the right pin shaft 243 eccentrically provided in the other direction from the shaft center X-1 and coupled to the right link mechanism 35.

In this case, as illustrated in FIG. 4B, the shaft centers X-1, X'-2, and X'-3 of the pin cam 45, the left pin shaft 240, and the right pin shaft 243 may be positioned on a straight line (i.e. X-axis), but not limited thereto. In coordinates, the left pin shaft 240 is positioned in the third quarter the pin cam 45, and the right pin shaft 243 is positioned in the first quarter. Accordingly, the lengths of the link mechanisms 30 and 35 coupled to the pin shafts 240 and 243 on both sides are adjusted to be lengthened or shortened, and thus the lengths of the valves 4 and 6 interlocking with the link mechanisms 30 and 35 can also be adjusted to be shortened or lengthened.

With the above-described construction, the principle of adjusting the lengths between the rocker arm 20 and the respective link mechanisms 30 and 35 by the adjustment member 290 of the apparatus for adjusting deviation for the continuously variable valve lift device according to the second exemplary embodiment of the present invention will be briefly described with reference to FIGS. 5A to 5C.

Figures 5A, 5B, 5C:
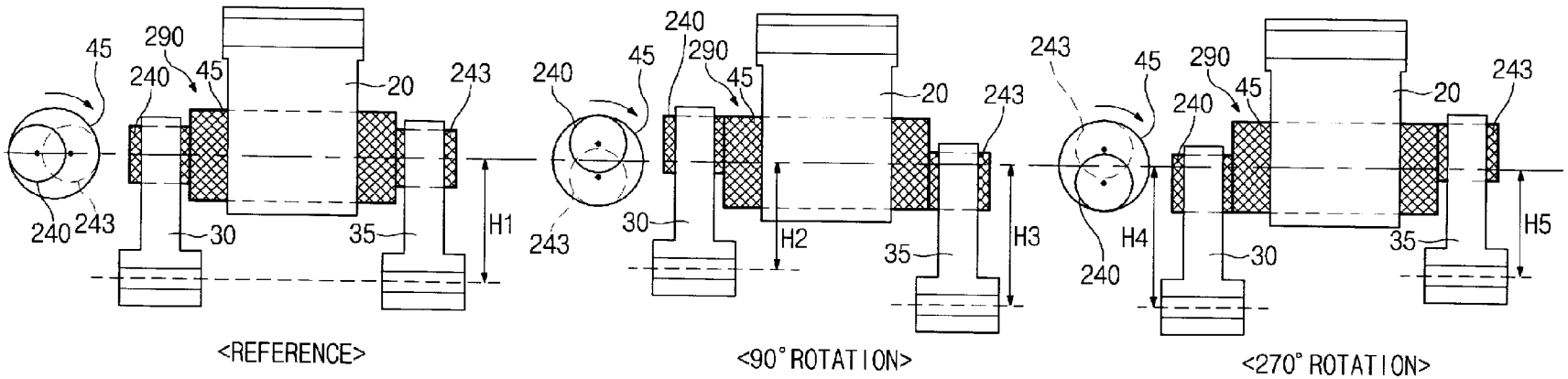
FIGS. 5A to 5C are schematic views explaining a process of adjusting lengths of link mechanisms when the adjustment member of FIG. 4A is rotated.

First, in the case where the length between the rocker arm 20 and the left link mechanism 30 and the length between the rocker arm 20 and the right link mechanism 35 are the same as H1 as shown in FIG. 5A, the adjustment member 290 is to be rotated clockwise. In this case, if the reverse rotation prevention member 60 is not provided as in the conventional device, the deviation of the valves 4 and 6 is adjusted by rotating the adjustment member 290. In the exemplary embodiment of the present invention, however, the reverse rotation prevention member 60 is provided, and the adjustment member 290 is rotated by rotating the reverse rotation prevention member 60 tooth-engaged with the adjustment member 290.

If the adjustment member 290 in the state as illustrated in FIG. 5A is rotated by 90° clockwise, the left link mechanism 30 engaged with the left pin shaft 240 ascends to make the length between the rocker arm 20 and the left link mechanism 30 H2, while the right link mechanism 35 engaged with the right pin shaft 243 descends to make the length between the rocker arm 20 and the right link mechanism 35 H3. That is, the length between the rocker arm 20 and the left link mechanism 30 is shortened to make the length of the valve 4 interlocking with the left link mechanism 30 lengthened, while the length between the rocker arm 20 and the right link mechanism 30 is lengthened to make the length of the valve 6 interlocking with the right link mechanism 30 shortened.

If the adjustment member 290 is further rotated by 90° clockwise in the state as illustrated in FIG. 5B, the left link mechanism 30 descends to make the length between the rocker arm 20 and the left link mechanism 30 lengthened, while the right link mechanism 35 ascends to make the length between the rocker arm 20 and the right link mechanism 35 shortened, as illustrated in FIG. 5A, so that the lengths of the link mechanisms 30 and 35 become equal to each other.

Then, if the adjustment member 290 is further rotated by 90° clockwise (i.e. by 270° clockwise in all), the left link mechanism 30 engaged with the left pin shaft 240 descends to make the length between the rocker arm 20 and the left link mechanism 30 H4, while the right link mechanism 35 engaged with the right pin shaft 243 ascends to make the length between the rocker arm 20 and the right link mechanism 35 H5. That is, the length of the left link mechanism 30 is lengthened to make the length of the valve 4 interlocking with the left link mechanism 30 shortened, while the length of the right link mechanism 35 is shortened to make the length of the valve 6 interlocking with the right link mechanism 30 lengthened.

As described above, by rotating the adjustment member 290, the lengths of the respective link mechanisms 30 and 35 can be adjusted to be equal to or different from each other, and thus the deviation of the output cams 13 and 17 can be easily corrected.

Figure 6A:
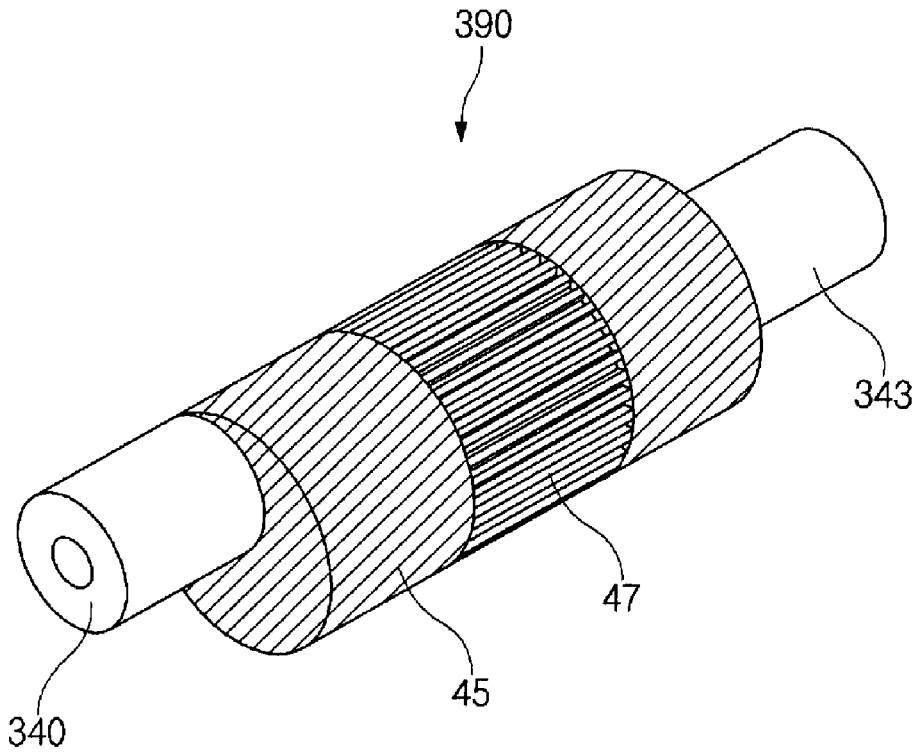
FIG. 6A is a perspective view illustrating an adjustment member of apparatus for adjusting deviation, provided in a continuously variable valve lift device, according to various embodiments of the present invention.
Figure 6B:
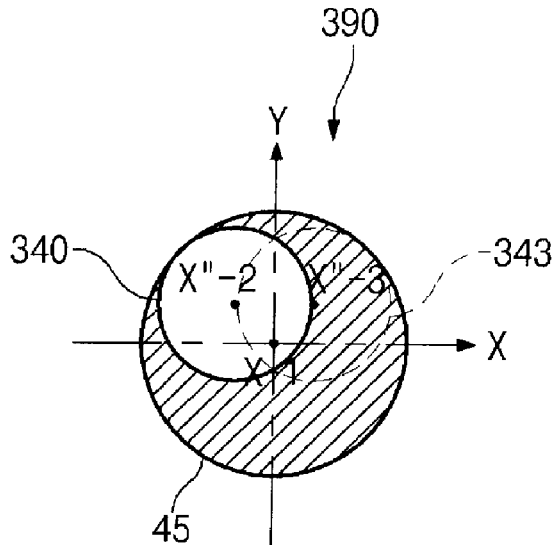
FIG. 6B is a front view of the adjustment member as illustrated in FIG. 6A.

The adjustment member 390 may also be modified as shown in FIGS. 6A and 6B.

The adjustment member 390 of the apparatus for adjusting deviation for a continuously variable valve lift device according to the third exemplary embodiment of the present invention is composed of a pin cam 45 coupled to the rocker arm 20, and plural pin shafts 340 and 343 which are eccentric in different directions from the shaft center X-1 of the pin cam 45 and are coupled to the link mechanisms 30 and 35, respectively.

In the adjustment member 390 according to the third exemplary embodiment of the present invention, the direction in which the left pin shaft 340 and the right pin shaft 343 are eccentric from the shaft center X-1 of the pin cam 45 is different from that in the adjustment member 290 according to the second exemplary embodiment of the present invention.

That is, in the adjustment member 290 according to the second exemplary embodiment of the present invention, the shaft center X'-2 of the left pin shaft 240 is in the third quarter and the shaft center X'-3 of the right pin shaft 243 is in the first quarter, whereas in the adjustment member 390 according to the third exemplary embodiment of the present invention, the shaft center X"-2 of the left pin shaft 340 is in the second quarter and the shaft center X"-3 of the right pin shaft 343 is in the first quarter.

According to the apparatus for adjusting deviation for a continuously variable valve lift device according to the second exemplary embodiment of the present invention, it is impossible to lower or heighten the respective link mechanisms 30 and 35 with the same length by the rotation of the adjustment member 290, and there are limitations in adjusting the deviation of a multi-cylinder engine. Accordingly, the apparatus for adjusting deviation according to the second exemplary embodiment of the present invention can be advantageously applied to a single-cylinder engine.

By contrast, according to the apparatus for adjusting deviation according to the third exemplary embodiment of the present invention, the respective link mechanisms 30 and 35 can be lowered or heightened with the same length by the rotation of the adjustment member 390, and thus the deviation of each cylinder can be adjusted. Accordingly, the apparatus for adjusting deviation according to the third exemplary embodiment of the present invention can be advantageously applied to a multi-cylinder engine.

For example, it is assumed that two intake valves are provided in each cylinder in a two-cylinder engine, and the deviations of the two intake valves match each other. In this case, in order to adjust the deviations of the intake valves of the respective cylinders, it is sometimes required to lower the intake valves in one cylinder and to heighten the intake valves in the other cylinder. In the apparatus for adjusting deviation according to the second exemplary embodiment of the present invention, if the adjustment member 290 is rotated, one link mechanism 30 or 35 ascends while the other link mechanism 30 or 35 descends, and thus it is impossible to lower or heighten both the link mechanisms 30 and 35. However, in the apparatus for adjusting deviation according to the third exemplary embodiment of the present invention, both the link mechanisms 30 and 35 can be lowered or heightened by the rotation of the adjustment member 390, and thus the deviations of the respective cylinders can be adjusted.

With the above-described construction, the principle of adjusting the lengths of the link mechanisms 30 and 35 by the adjustment member 390 of the apparatus for adjusting deviation for the continuously variable valve lift device according to the third exemplary embodiment of the present invention will be briefly described with reference to FIGS. 7A to 7E.

Figures 7A, 7B, 7C, 7D, 7E:
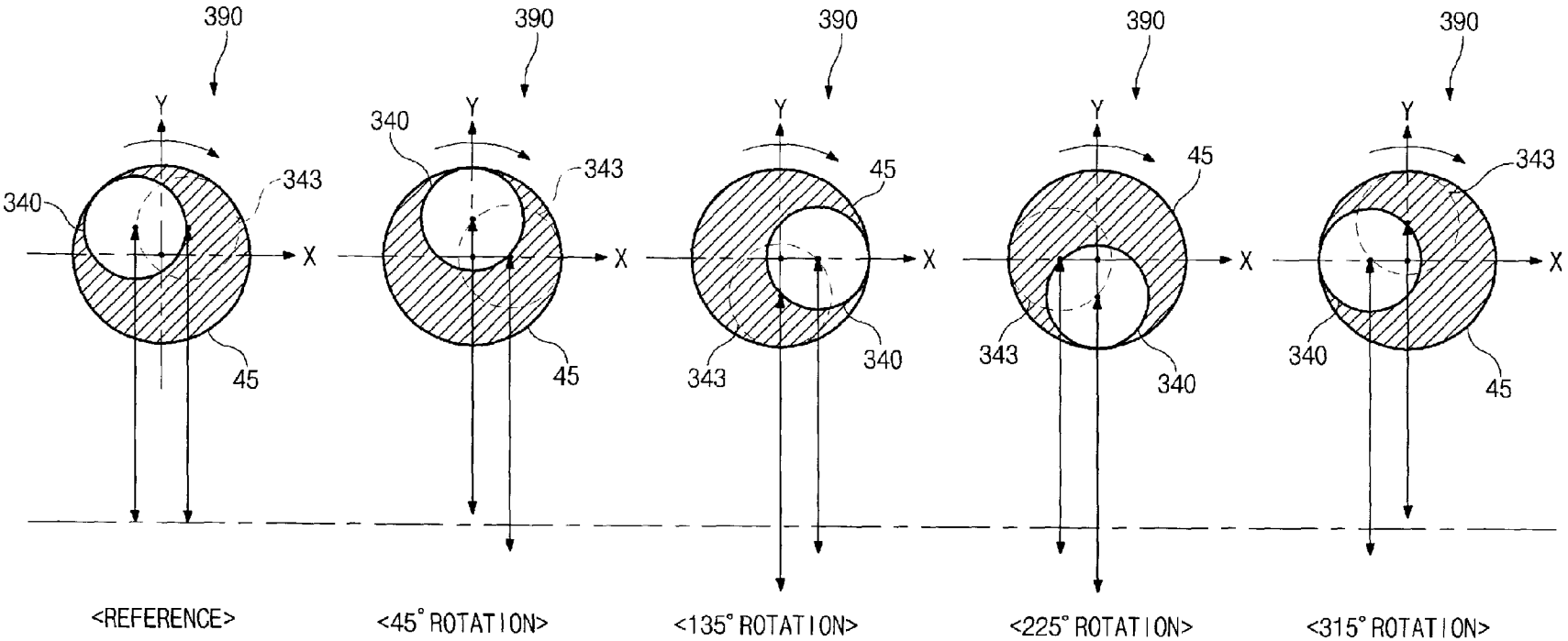
FIGS. 7A to 7E are schematic views explaining a process of adjusting lengths of link mechanisms when the adjustment member of FIG. 6A is rotated.

First, in the case where the length between the rocker arm 20 and the left link mechanism 30 and the length between the rocker arm 20 and the right link mechanism 35 are equal to each other as shown in FIG. 7A, the adjustment member 390 is to be rotated clockwise. In the same manner as the second exemplary embodiment of the present invention, if the reverse rotation prevention member 60 is not provided, the deviations of the valves are adjusted by rotating the adjustment member 390. In the exemplary embodiment of the present invention, however, the reverse rotation prevention member 60 is provided, and the adjustment member 390 is rotated by rotating the reverse rotation prevention member 60 tooth-engaged with the adjustment member 390.

If the adjustment member 390 in the state as illustrated in FIG. 7A is rotated by 45° clockwise, as illustrated in FIG. 7B, the left link mechanism 30 engaged with the left pin shaft 340 ascends to make the length between the rocker arm 20 and the left link mechanism 30 shortened, while the right link mechanism 35 engaged with the right pin shaft 243 descends to make the length between the rocker arm 20 and the right link mechanism 35 lengthened.

On the other hand, if the adjustment member 390 is rotated by 135° clockwise in the state as illustrated in FIG. 7B, the left link mechanism 30 descends to make the length between the rocker arm 20 and the left link mechanism 30 lengthened, while the right link mechanism 35 also descends to make the length between the rocker arm 20 and the right link mechanism 35 lengthened, as illustrated in FIG. 7C. As described above, according to the apparatus for adjusting deviation for a continuously variable valve lift device according to the third exemplary embodiment of the present invention, both the left link mechanisms 30 and the right link mechanism 35 may descend in the same manner, and thus it is easy to adjust the deviation of the valves for the respective cylinders (If the adjustment member 390 is rotated counterclockwise, both the left link mechanism 30 and the right link mechanism 35 may ascend in the same manner).

If the adjustment member 390 is rotated by 225° clockwise, as illustrated in FIG. 7D, the left link mechanism 30 coupled to the left pin shaft 340 further descends to make the length between the rocker arm 20 and the left link mechanism 30 further shortened, while the right link mechanism 35 coupled to the right pin shaft 343 ascends to make the length between the rocker arm 20 and the right link mechanism 35 lengthened in comparison to the state as illustrated in FIG. 7C.

Last, if the adjustment member 390 is rotated by 315° clockwise, the left link mechanism 30 coupled to the left pin shaft 340 ascends to make the length between the rocker arm 20 and the left link mechanism 30 shortened in comparison to the state as illustrated in FIG. 7D, while the right link mechanism 35 coupled to the right pin shaft 343 ascends to make the length between the rocker arm 20 and the right link mechanism 35 shortened in comparison to the state as illustrated in FIG. 7D, resulting in that the length becomes further shortened in comparison to the reference state as illustrated in FIG. 7A.

In the above-described operation principle, if the adjustment member 390 is rotated, the lengths of the link mechanisms 30 and 35 coupled to the pin shafts 340 and 343 are adjusted to be equal to or different from each other, and thus the deviation of the output cams 13 and 17 interlocking with them can be easily adjusted.

In the above-described exemplary embodiments of the present invention, the deviation of a pair of output cams is adjusted by one apparatus for adjusting deviation for the continuously variable valve lift device. However, the number of apparatus for adjusting deviation can be diversely changed in accordance with the connection structure of the rocker arm and the link mechanisms.

For convenience in explanation and accurate definition in the appended claims, the terms "upper" and "lower" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An apparatus for adjusting deviation of a valve for a continuously variable valve lift device, comprising an adjustment member eccentrically connecting a rocker arm to a plurality of output cams to adjust lengths between the rocker arm and the output cams, respectively, so that the lengths become equal or different; and a reverse rotation prevention member installed in a mount portion of the rocker arm and coupled to the adjustment member to prevent reverse rotation of the adjustment member.

2. The apparatus of claim 1, wherein the adjustment member includes:

a pin cam having a worm wheel formed on an outer periphery thereof, the reverse rotation prevention member having a worm gear formed thereon to be engaged with the worm wheel; and a plurality of pin shafts connected to the pin cam, wherein center axes of the pin shafts are eccentrically provided from a rotation axis of the pin cam and connected to the plurality of output cams by link mechanisms respectively.

3. The apparatus of claim 2, wherein a rotation axis of the reverse rotation prevention member and the rotation axis of the pin cam are perpendicular.

4. The apparatus of claim 2, wherein the center axes of the plurality of pin shafts are positioned in any one of a first quadrant to a fourth quadrant, based on the rotation axis of the pin cam.

5. The apparatus of claim 2, wherein an included angle between the center axes of the plurality of pin shafts with respect to the rotation axis of the pin cam is approximately zero.

6. The apparatus of claim 2, wherein the center axes of the plurality of pin shafts are positioned in a first quadrant and a third quadrant, respectively, based on the rotation axis of the pin cam.

7. The apparatus of claim 2, wherein an included angle between the center axes of the plurality of pin shafts with respect to a rotation axis of the pin cam are approximately 180 degrees.

8. The apparatus of claim 2, wherein the center axes of the plurality of pin shafts are positioned in a first quadrant and a second quadrant, respectively, based on the rotation axis of the pin cam.

9. The apparatus of claim 2, wherein an included angle between the center axes of the plurality of pin shafts with respect to the rotation axis of the pin cam are approximately 90 degrees or less.

10. The apparatus of claim 9, wherein the plural link mechanisms are coupled to the plurality of pin shafts, respectively, and a part where the worm wheel is engaged with the worm gear is positioned in the center of the pin cam.

11. The apparatus of claim 2, wherein the adjustment member connects plural link mechanisms, which are provided between the plurality of output cams and the rocker arm, respectively, to the rocker arm.

12. A continuously variable valve lift device, comprising:

an eccentric cam shaft having eccentric cams installed on an outer periphery thereof;

a rocker arm rotatably installed on the eccentric cams to interlock with a plurality of output cams; and apparatus for adjusting deviation, provided on the rocker arm, to adjust lengths between the rocker arm and the output cams so that the lengths become equal to or different from each other, as recited in claim 1.

* * * * *